US007685748B1

(12) United States Patent
Anderson

(10) Patent No.: US 7,685,748 B1
(45) Date of Patent: Mar. 30, 2010

(54) VEHICULAR PLOW

(75) Inventor: Joseph P. Anderson, Spencer, IA (US)

(73) Assignee: Cycle Country Accessories Corporation, Spencer, IA (US)

( * ) Notice: Subject to any disclaimer, the term of this patent is extended or adjusted under 35 U.S.C. 154(b) by 0 days.

(21) Appl. No.: 12/316,903

(22) Filed: Dec. 17, 2008

(51) Int. Cl.
*E01H 5/06* (2006.01)

(52) U.S. Cl. ..... 37/266

(58) Field of Classification Search ..... 37/196, 37/197, 231, 232, 266, 272, 275, 241; 172/253, 172/810, 811, 817
See application file for complete search history.

(56) References Cited

U.S. PATENT DOCUMENTS 4,574,502 A 3/1986 Blau
4,803,790 A 2/1989 Ciula
4,845,866 A 7/1989 Ciula
5,088,215 A 2/1992 Ciula
6,009,642 A * 1/2000 Nugent ..... 37/231
6,240,658 B1 * 6/2001 Knutson et al. ..... 37/231
6,564,479 B1 5/2003 Vickers

* cited by examiner

*Primary Examiner*—Robert E Pezzuto
(74) *Attorney, Agent, or Firm*—Dennis L. Thomte; Thomte Patent Law Office LLC

(57) ABSTRACT

A vehicular plow comprises front and back plastic sheet members which are molded together to form a single seamless piece or moldboard. The back side of the moldboard has reinforcing ribs and rib members molded thereinto to add strength and rigidity to the plow. The plow is lightweight, frameless, durable and will not rust.

15 Claims, 5 Drawing Sheets

VEHICULAR PLOW

BACKGROUND OF THE INVENTION

1. Field of the Invention

This invention relates to a plow which is normally mounted on the front of a vehicle such as an All Terrain Vehicle (ATV) or the like for plowing snow, dirt or other materials. More particularly, the invention relates to a frameless plastic plow.

2. Description of the Related Art

Many plows have been previously provided which may be mounted on a vehicle such as an ATV for plowing snow, dirt, etc. Historically, the prior art plows have been constructed of metal materials such as iron, steel, etc. Although the metal plows have met with much success, they do suffer from certain disadvantages or drawbacks. The metal plows are quite heavy, require very sturdy supporting structures, and lift mechanisms. The metal plows also tend to rust and require factory painting as well as rust preventative painting from time to time.

In an effort to improve upon the conventional metal plows, the moldboards thereof have been formed of a light-weight plastic material such as a high density polyethylene. A drawback to the prior art plastic plows is that they have required a metal frame extending therearound and which has the plastic moldboard secured thereto to add rigidity to the plastic moldboard which tends to flex or bend when engaging snow, dirt or the like. The requirement of the metal frame increases the weight of the plow, adds expense to the fabrication of the plow, and requires painting of the metal frame at the factory and periodic painting thereof to prevent rusting of the same.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A vehicular plow for plowing snow, dirt or other materials is disclosed. The plow includes a plastic moldboard formed from two sheets of plastic using a twinsheet thermoform process producing one seamless piece. The back of the plastic moldboard has a mounting means secured thereto which is adapted to be secured to a vehicle. A wear plate is secured to the lower end of the plastic sheet moldboard at the front side thereof. The back side of the plastic moldboard has a plurality of horizontally spaced-apart and rearwardly extending ribs molded therewith. The back side of the plastic moldboard also has a plurality of rearwardly extending reinforcing rib members molded therewith which are secured to and extend between at least some of the horizontally spaced-apart ribs.

An elongated support member is secured to the back of the plastic moldboard adjacent the lower end thereof. A pair of horizontally spaced-apart mounts are positioned at the back side of the plastic moldboard. The upper ends of the mounts are secured to the plastic moldboard by bolts extending therethrough. The lower ends of the mounts are secured to the elongated support member. A pair of skid members are secured to the support member in a rotatable fashion. The plow is lightweight, frameless and has the desired color molded thereinto.

It is therefore a principal object of the invention to provide an improved vehicular plow which is comprised of a plastic material such as a high-density polyethylene material.

A further object of the invention is to provide a plastic plow of the type described which will not rust.

A further object of the invention is to provide a plastic plow which does not require a frame.

A further object of the invention is to provide a plastic plow blade or moldboard which weighs approximately nine pounds as compared to the approximate weight of 25 pounds for a comparably sized steel blade.

A further object of the invention is to provide a plastic plow blade or moldboard which is resilient so that it may be deformed and returned to its original shape.

Yet another object of the invention is to provide a plastic plow blade comprised of front and back plastic sheet members which are molded together to form a single seamless piece.

Still another object of the invention is to provide a plastic plow blade which has reinforcing ribs molded thereinto.

Still another object of the invention is to provide a plow which does not require painting.

A further object of the invention is to provide a plow of the type described which is durable in use, refined in appearance and economical of manufacture.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
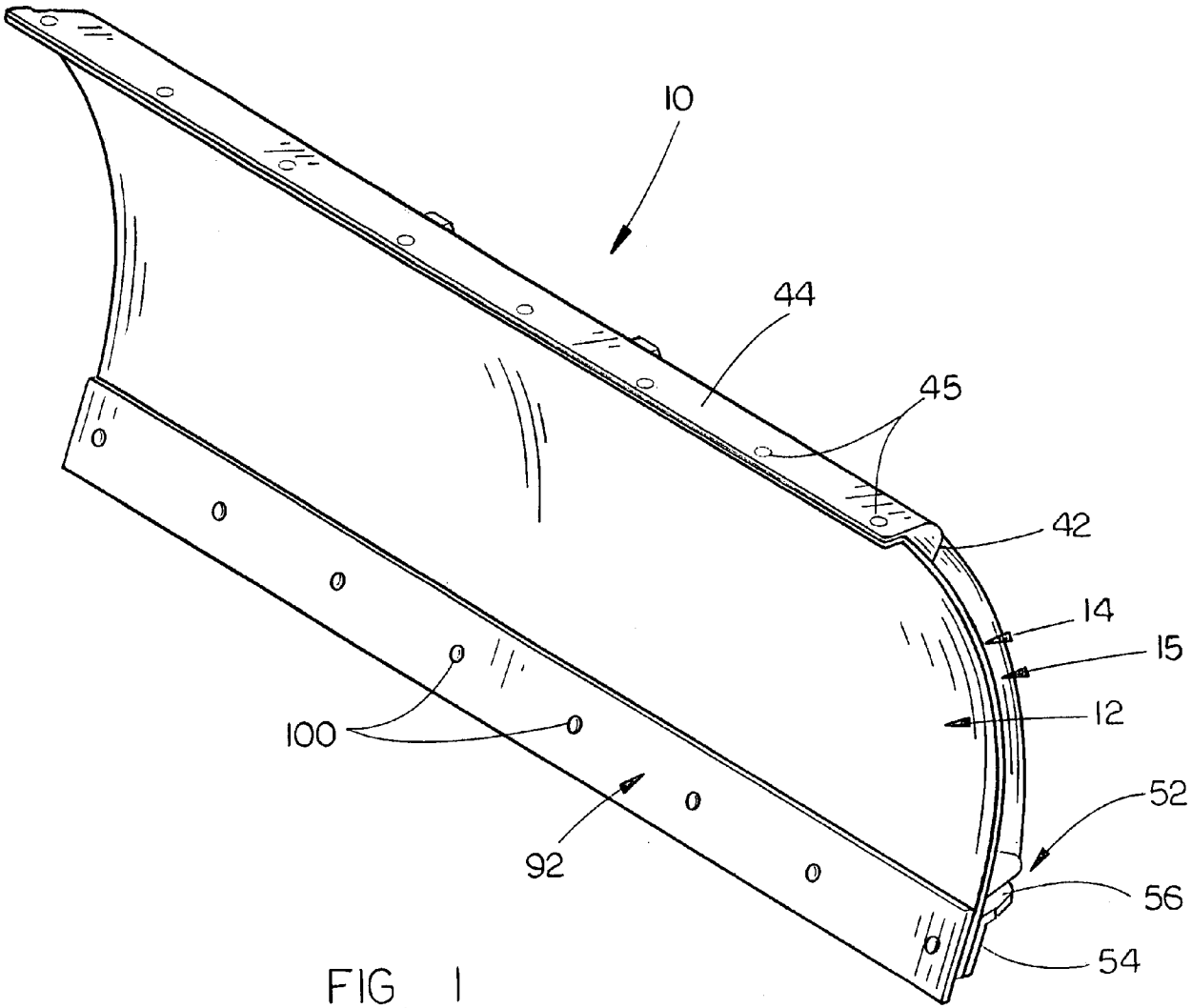
FIG. 1 is a front perspective view of the vehicular plow of this invention.
Figure 2:
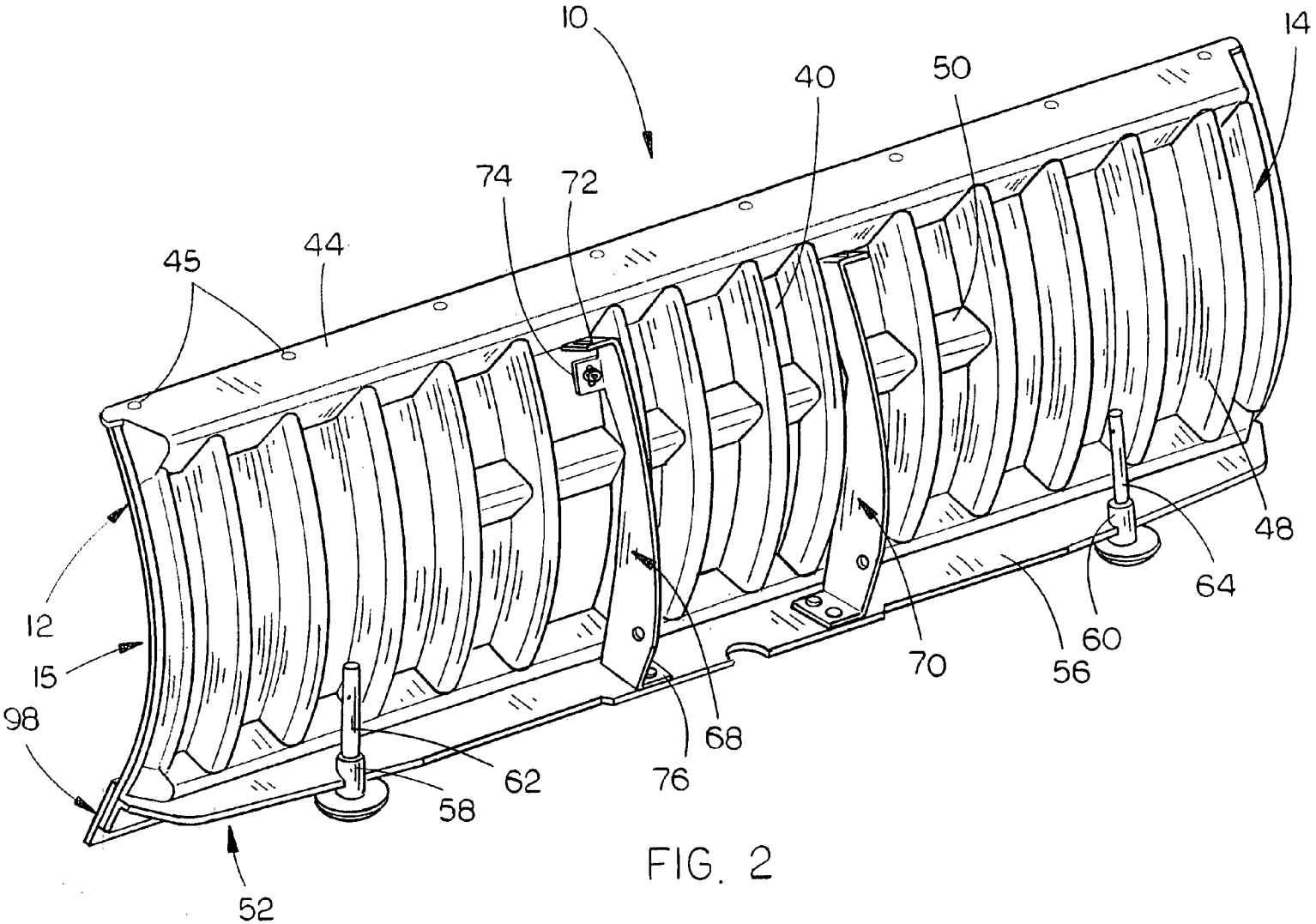
FIG. 2 is a rear perspective view of the vehicular plow of this invention.
Figure 3:
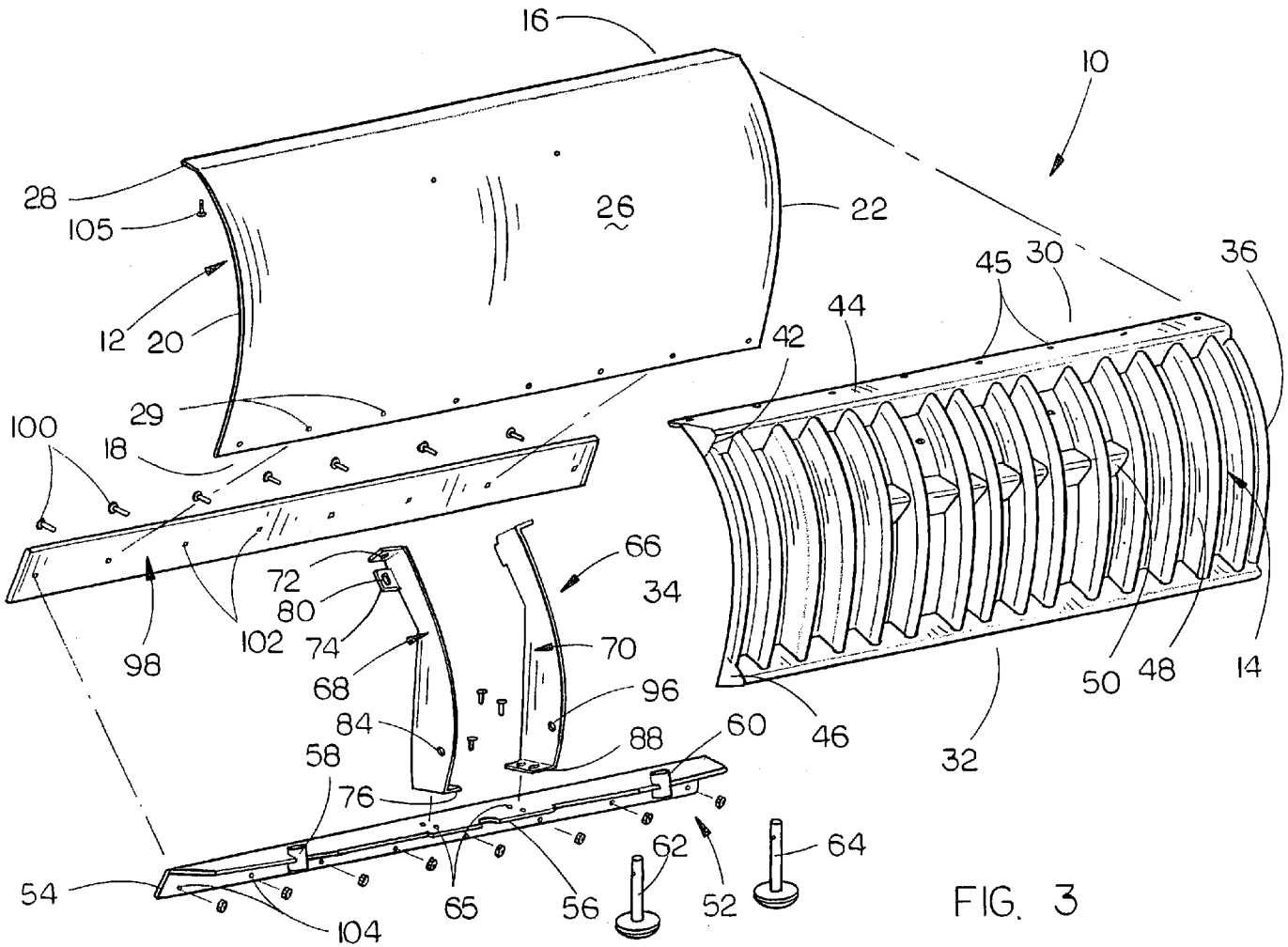
FIG. 3 is an exploded rear perspective view of the vehicular plow of this invention prior to the two plastic sheet members being molded together.
Figure 4:
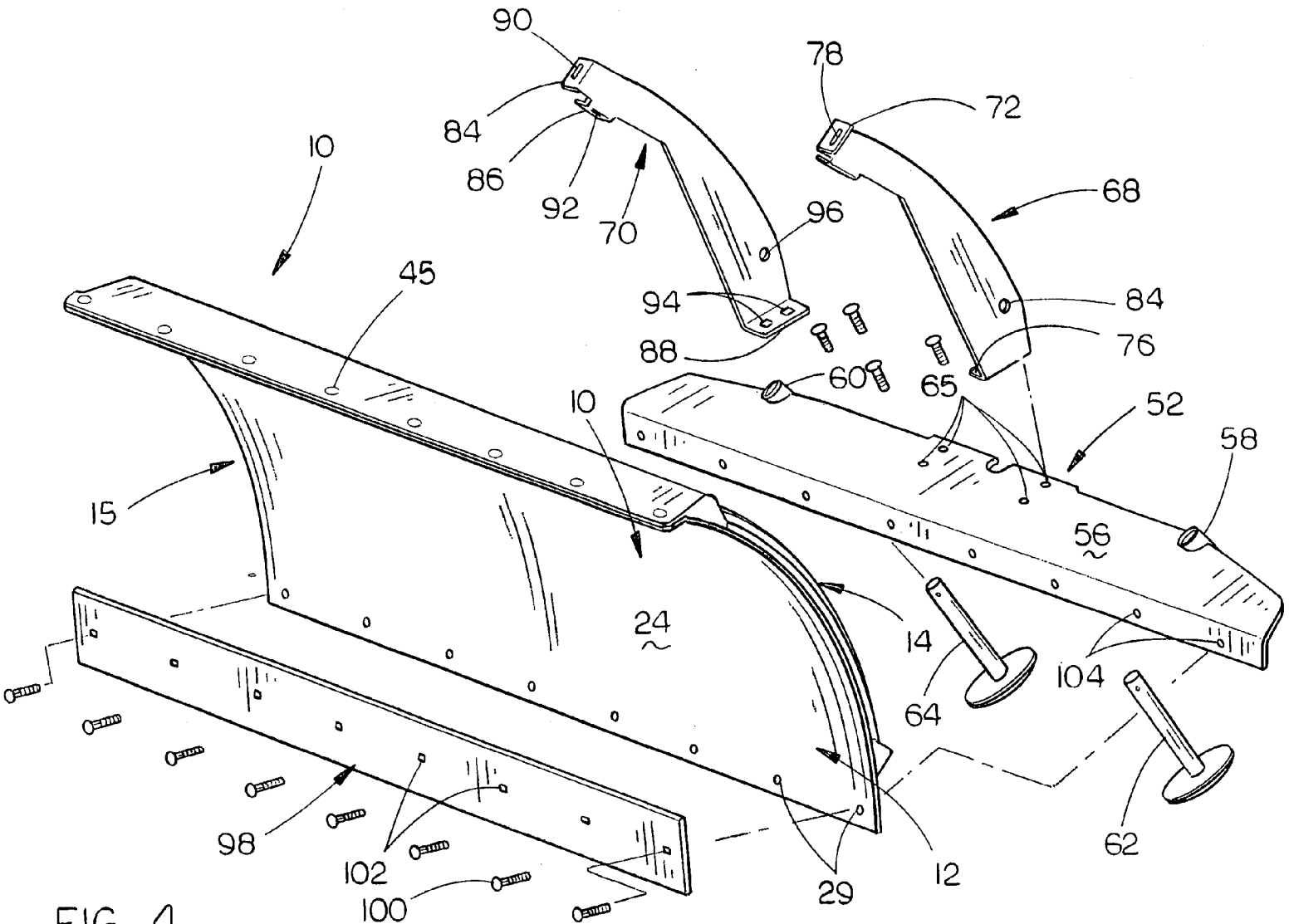
FIG. 4 is a partial exploded front perspective view of the vehicular plow of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to the plow of this invention which is primarily designed to plow snow but which may be used to plow dirt or other materials. The plow 10 is designed to be attached to a vehicle such as an All Terrain Vehicle (ATV) at either the forward end thereof or the rearward end thereof. However, for purposes of description, plow 10 will be described as it would be mounted on the forward end of a vehicle.

Plow 10 includes a front plastic sheet member 12 and a back plastic sheet member 14 which are molded together using a twinsheet thermoforming process producing one seamless piece moldboard 15. The preferred plastic of the sheet moldboard 15, as well as the other components of the plow, is a high-density polyethylene. For purposes of description, front plastic sheet member 12 will be described as having an upper end 16, a lower end 18, opposite ends 20 and 22, a front side 24 and a back side 26. Front plastic sheet member 12 has a forwardly extending ledge or shoulder 28 at its upper end. The lower end of front plastic sheet member 12 is provided with a plurality of openings 29 formed therein which are adapted to receive threaded connectors therein such as bolts.

Figure 5:
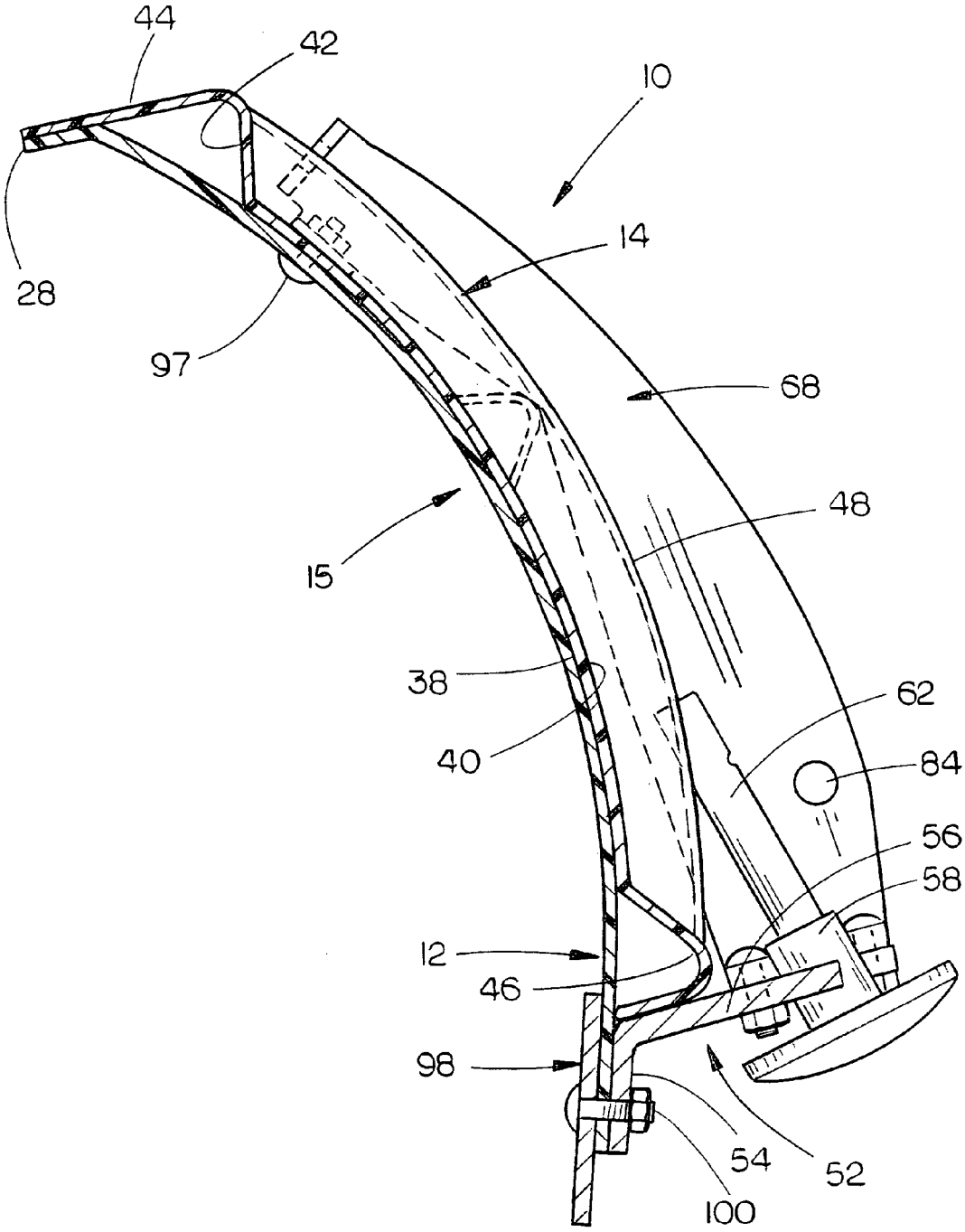
FIG. 5 is a sectional view of the vehicular plow of this invention.

Back plastic sheet member 14 will be described as having an upper end 30, a lower end 32, opposite ends 34 and 36, a front side 38 and a back side 40. As seen in FIG. 5, the upper end 30 of back plastic sheet member 14 includes a generally vertically disposed shoulder 42 and a forwardly extending shoulder or ledge 44. The forward end of ledge 44 is provided with a plurality of dimples 45 formed therein adapted to receive plow accessories. As also seen, sheet member 14 has a generally "V" or "U" shaped channel portion 46 at its lower end. Sheet member 14 has a plurality of horizontally spaced-apart strengthening ribs 48 molded therein so as to extend rearwardly therefrom. Sheet member 14 also has a plurality of strengthening rib members 50 which are molded therewith which are secured to and extend between at least some of the ribs 48.

The numeral 52 refers to an elongated support member which has an angular cross-section and which includes leg portions 54 and 56. Leg portion 56 has a pair of collars 58 and 60 provided therein adapted to have skid members 62 and 64 rotatably secured thereto respectively. Leg portion 56 is provided with a plurality of openings 65 formed therein to enable the vehicle blade mounting means to be secured thereto. Mounting means 66 includes a pair of mounts 68 and 70 which are bolted to the back of the moldboard 15 and to the support member 52.

Mount 68 has a laterally extending bracket 72 at its upper end, a laterally extending bracket 74 positioned below its upper end, and a laterally extending bracket 76 at its lower end. Bracket 72 has an opening 78 formed therein and bracket 74 has an opening 80 formed therein. Bracket 76 has a pair of openings formed therein. Mount 68 also has an opening 84 formed therein.

Mount 70 has a laterally extending bracket 84 at its upper end, a laterally extending bracket 86 below its upper end, and a laterally extending bracket 88 at its lower end. Bracket 84 has an opening 90 formed therein and bracket 86 has an opening 92 formed therein. Bracket 88 has a pair of openings 94 formed therein. Mount 70 also has an opening 96 formed therein.

Mount 68 and 70 are secured to moldboard 15 by threaded connectors 97 extending through openings 80 and 92 of brackets 74 and 86 respectively and through moldboard 15 (FIG. 5). Brackets 76 and 78 of mounts 68 and 70 respectively are secured to leg portion 56 of support member 52 by threaded connectors extending through the openings in bracket 76 and through openings 94 in bracket 88 of mounts 68 and 70. The brackets 72 and 84 may be utilized to attach the mounts 68 and 70 to the blade lift mechanism of the ATV. The openings 84 and 96 in mounts 68 and 70 respectively may be utilized to attach other components of the blade mounting and/or lift mechanism of the ATV.

The numeral 98 refers to a removable wear plate which is selectively secured to the lower end of the moldboard 15 by means of threaded connectors (bolts) 100 extending through openings 102 in wear plate 98 and through openings 29 formed in front sheet member 12 of moldboard 15 and through openings 104 formed in leg portion 54 of support member 52.

The concept of utilizing a double wall structure greatly strengthens the plastic plow with the strength thereof further being enhanced by the reinforcing ribs 48 and the rib members 50. The plow is lightweight, frameless and is resilient. The resiliency of the plow permits it to deform and then return to its original shape. A further advantage of the plow of this invention is that the plow will never rust since it is made of a plastic material. Since the plow is molded in the desired color, there is no finish, i.e., paint or powder coat, to wear off. The plastic construction of the plow enables the plow to weigh approximately nine pounds as compared to a steel plow of comparable size which will weigh approximately 25 pounds.

Thus it can be seen that the plow of this invention is lightweight, durable without the need of a frame, and will never rust. It can therefore be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. A vehicular plow for plowing materials comprising:

a front plastic sheet member having an upper end, a lower end, opposite ends, a front side and a back side;

and a back plastic sheet member having an upper end, a lower end, opposite ends, a front side and a back side;

said front side of said back plastic sheet member being positioned adjacent said back side of said front plastic sheet member;

said front and back plastic sheet members being substantially co-extensive with one another;

said front and back plastic sheet members being molded together to form a single piece seamless moldboard having a front side, a back side, an upper end and a lower end;

said moldboard having a mounting means secured thereto at said back side thereof adapted to be secured to a vehicle;

said back side of said moldboard has a plurality of horizontally spaced-apart rearwardly extending ribs molded therewith.

2. The plow of claim 1 wherein an elongated support member is secured to said moldboard at said back side thereof adjacent said lower end thereof.

3. The plow of claim 2 wherein a wear plate is secured to said lower end of said moldboard at said front side thereof.

4. The plow of claim 3 wherein threaded connectors extend through said wear plate, said moldboard and said support member.

5. The plow of claim 3 wherein said wear plate is comprised of a plastic material.

6. The plow of claim 3 wherein said wear plate is comprised of a steel material.

7. The plow of claim 4 wherein said wear plate is comprised of a plastic or steel material.

8. The plow of claim 1 wherein said back side of said moldboard also has a plurality of rearwardly extending reinforcing rib members molded therewith which are secured to and extend between at least some of said horizontally spaced-apart ribs.

9. The plow of claim 2 wherein said support member has an angular cross-section.

10. The plow of claim 2 wherein a plurality of spaced-apart skid members are secured to said support member.

11. The plow of claim 2 wherein a pair of horizontally spaced-apart mounts, having upper and lower ends, are positioned at said back side of said moldboard, said upper ends of said mounts being secured to said moldboard, said lower ends of said mounts being secured to said support member.

12. The plow of claim 2 wherein said moldboard has a horizontally extending channel molded therewith at its said back side which is positioned closely adjacent said support member.

13. The plow of claim 1 wherein said moldboard has a horizontally extending channel molded therewith at it said upper end.

14. The plow of claim 12 wherein said channel is a strengthening member.

15. The plow of claim 13 wherein said channel is a strengthening member.

* * * * *